United States Patent [19]

Lesley

[11] Patent Number: 5,065,711

[45] Date of Patent: Nov. 19, 1991

[54] INTERNAL COMBUSTION ENGINES

[75] Inventor: Samuel Lesley, Shoreham-by-Sea, England

[73] Assignee: Ricardo Group PLC, Shoreham-by-Sea, England

[21] Appl. No.: 622,814

[22] Filed: Dec. 5, 1990

[30] Foreign Application Priority Data

Dec. 15, 1989 [GB] United Kingdom ..... 8928386

[51] Int. Cl.[5] ..... F01L 3/00

[52] U.S. Cl. ..... 123/188 M; 123/308; 123/432

[58] Field of Search ..... 123/188 M, 308, 432, 123/306

[56] References Cited

U.S. PATENT DOCUMENTS

| | | | |
|---|---|---|---|
| 4,291,655 | 9/1981 | Yamakawa | 123/306 |
| 4,294,207 | 10/1981 | May | 123/306 |
| 4,550,699 | 11/1985 | Okumura et al. | 123/188 M |
| 4,805,569 | 2/1989 | Suzumura | 123/308 |
| 5,020,485 | 6/1991 | Watanabe | 123/193 P |

*Primary Examiner*—E. Rollins Cross
*Assistant Examiner*—Erick Solis
*Attorney, Agent, or Firm*—McAulay Fisher Nissen Goldberg & Kiel

[57] ABSTRACT

The two-stroke engine includes at least one cylinder, a piston reciprocable within the cylinder and a cylinder head which contains at least one exhaust port which is controlled by a poppet valve and at least two inlet ports which are controlled by respective poppet valves and are connected to respective inlet ducts. The inlet ports are of directed type with the axes of the inlet ducts being convergent in the direction of flow whereby the air flowing through them into the cylinder flows preferentially generally towards the cylinder axis. The axes of the inlet ducts pass substantially through the cylinder axis where the air flows through the inlet ports merged to form a single air flow on or adjacent the cylinder axis.

11 Claims, 3 Drawing Sheets

INTERNAL COMBUSTION ENGINES

The present invention relates to internal combustion engines and is concerned with spark ignited or compression ignited engines, preferably of two-stroke but also of four-stroke type, which include at least one cylinder, a piston reciprocable within the cylinder and a cylinder head which contains at least one exhaust port which is controlled by a poppet valve and at least two inlet ports controlled by respective poppet valves and connected to respective inlet ducts, the inlet ports being of directed type with the axes of the inlet ducts being convergent in the direction of flow whereby the air flowing through them into the cylinder flows preferentially in one radial direction relative to the associated valve axis generally towards the cylinder axis. Directed ports are that type of port in which the air flowing through it into the cylinder flows preferentially in one radial direction relative to the associated valve axis. Such ports communicate with an inlet duct which has a relatively abrupt bend shortly upstream of the port. The radius of the inside of the bend is typically less than 0.3 r where r is the radius of the port, and is substantially less than the radius of the outside of the bend whereby, in use, the air flow breaks away from the inside of the bend and enters the cylinder preferentially in the direction determined by the inlet duct upstream of the bend, i.e. the direction is substantially unaffected by the bend. The air thus enters the cylinder predominantly on one side of the port with respect to the valve axis.

It is known that in spark ignited four-stroke engines a high degree of turbulence in the inlet charge of fuel and air promotes rapid and complete combustion. It is known to produce such turbulence by the provision of so-called "squish" areas in which part of the upper surface of the piston closely approaches a corresponding part of the cylinder head during its approach to the top dead centre (TDC) position of the piston thereby squeezing air out of this area into the combustion chamber and producing intense turbulence of the air and fuel at the TDC position. It is also known to generate swirl in the inlet charge as it enters the cylinder which is largely converted into turbulence as the piston approaches the TDC position.

An alternative method of generating turbulence around TDC is to induce "tumbling" motion of the air in the cylinder by constructing the inlet port(s) so that they produce rotation of the air in the cylinder about an axis which is transverse to the axis of the cylinder. Unlike swirl, which tends to continue in the cylinder beyond TDC, tumbling motion is wholly converted into turbulence at TDC. "Tumbling" motion is effective not only for producing turbulence in two-stroke and four-stroke engines but also for purging two-stroke engines. Known engines of this type include inlet ducts which are substantially parallel to the cylinder axis whereby air flowing in through the inlet ports flows predominantly down the adjacent side of the cylinder and is then caused to flow across the piston and up the other side of the cylinder, thereby creating a degree of tumbling motion. Such engines are described in GB-A-1568302 and EP-A-0299385.

In recent years there has been considerable interest in the use of the two-stroke cycle in vehicle engines so that a smaller and lighter engine may be obtained. Two-stroke engines have a very limited time in which to complete the processes of exhausting the burnt gases and inletting the fresh charge of combustion air. Ideally, these processes are effected separately and consecutively. However, in practice there is insufficient time to do this. In all two-stroke engines the period for which the inlet valve is open therefore overlaps with that in which the exhaust valve is open. There is therefore a tendency for the incoming air to flow straight from the inlet valve to the exhaust valve without purging exhaust gases from the cylinder.

Many methods have been devised to avoid this short-circuit air flow. In the majority of small two-stroke engines the inlet ports are controlled by the piston and are on one side of the cylinder and the exhaust ports which are also controlled by the piston are on the other side. The incoming air is made to circulate up one wall of the cylinder, across the cylinder head and down the opposite wall of the cylinder thereby purging the cylinder of exhaust gases via the exhaust port.

In larger engines the exhaust port may be controlled by a poppet valve and located in the cylinder head and the inlet ports are still controlled by the piston. Air flowing in through the inlet ports in the cylinder wall flows axially along the cylinder to purge it of exhaust gases via the exhaust valve.

Recent advances in fuel injection systems have made it possible to design compact two-stroke engines for motor vehicles in which both the inlet and outlet ports are controlled by the piston without the disadvantage of high emissions of hydrocarbons. However, the use of ports which are controlled by the piston leads to the problem of excessive distortion of the cylinder due to the asymmetrical thermal loading. The consequent distortion of the cylinder creates problems of sealing and of friction and thus wear.

There is therefore now increased interest in the use of two-stroke engines with a fuel injection system and with inlet and exhaust ports controlled by poppet valves. In such engines the inlet and exhaust ports and their poppet valves are housed entirely in the cylinder head. However, this results in the inlet ports inherently being relatively close to the exhaust ports so the tendency referred to above, namely of inlet air to flow directly from the inlet ports to the exhaust ports, is exacerbated. The prior patents referred to above disclose methods of overcoming this problem.

However, the "tumbling" air motion in the prior patents referred to above has the disadvantage in two-stroke engines that at high engine speeds the cooled inlet air is caused to flow preferentially to the outer areas of the cylinder by the action of centrifugal force thereby leaving a mass of unpurged exhaust gases in the centre of the cylinder. "Tumbling" air motion may therefore only be of use in two-stroke engines with a relatively low top speed, i.e. a limited speed range.

EP 0235121, on which the precharacterising portion of claim 1 is based, discloses an engine in which each cylinder has two inlet ports and a single exhaust port. The inlet ports direct the air preferentially towards the cylinder axis and the axes of the inlet ducts and thus of the inflowing air streams, are slightly convergent. These axes are relatively shallowly inclined, when viewed from the side, and, if projected in the direction of flow, would intersect at a distance of about 2.25 R from the axis of the cylinder (where R is the radius of the cylinder) at a point which is not very significantly below the cylinder head. The two air flows from the inlet ports thus merge at the cylinder wall below the exhaust port and flow down the wall and then across the piston crown and then up the other wall. The air flow is, however, then on the wrong side of the cylinder to flow readily out of the exhaust port. This means that the valve arrangement disclosed in this prior specification produces an air pattern which is very unsatisfactory for, e.g. purging the cylinder of a two-stroke engine.

It is the object of the invention to provide an engine of the type referred to above in which, in two-stroke form, the inlet air produces an effective purging of the exhaust gases remaining from the previous combustion cycle, even from the centre of the cylinder when the engine is running at high speed, and which, in two-stroke or four-stroke form, produces a vigorous motion of the inlet air and thus intense turbulence at TDC.

According to the present invention an engine of the type referred to above is characterised in that the axes of the inlet ducts pass substantially through the cylinder axis whereby the air flows through the inlet ports merge to form a single air flow on or adjacent the cylinder axis. The air flows from the inlet ports flow generally axially in the cylinder but biased so as to flow out of the ports on the side closest the cylinder axis and towards the cylinder axis. The axis of each inlet duct thus has a substantial axial component, e.g. is inclined by 60°, more preferably 45°, or less to a line parallel to the cylinder axis, the line intersecting the axis of the inlet duct. Thus in the engine in accordance with the invention the flows of inlet air merge into a single compact, vigorous air flow which flows towards the piston predominantly along or adjacent to the axis of the cylinder and thus if the engine is of two-stroke type the centre of the cylinder is effectively purged. The inflowing air is then deflected laterally by the piston and flows upwardly again and thus purges all the exhaust gases out through the exhaust valve(s) in the case of a two-stroke engine. The air motion is converted into intense turbulence at TDC and thus promotes effective combustion in both two-stroke and four-stroke engines. The invention is applicable not only to spark ignited engines but also to compression ignited engines, i.e. diesel engines.

The convergency of the inlet air flows towards the cylinder axis is found to result not only in more effective purging of two-stroke engines but also in more intense turbulence in both two- and four-stroke engines. If there are only two inlet ports it is preferred that they converge at an angle of at least 40° but it will be appreciated that there may be more than two inlet ports and in this event it is preferred that the axes of the two outer inlet ducts are inclined by at least 40° whilst the axis of the duct or ducts between them is inclined to their ducts by a lesser angle. Thus if there are three inlet ports, the ducts of the two outer ports will be inclined by 40° or more and the duct of the central port may for instance, extend vertically and thus be inclined to the ducts of the other ports by 20° or more. The axis of an inlet duct is the direction in which the major proportion of the length of the duct extends and thus the predominant direction of the momentum of the air flowing within the duct and it will be appreciated that if, as is usual, there is a bend in the inlet duct shortly before the inlet port, that is to say the inlet valve seat, the axis of the duct is coincident with the axis of the portion of the duct upstream of the bend.

It is preferred that the axis of each inlet port is inclined away from the axis of the cylinder in the direction of flow and this means that the air flowing through each inlet port is predominantly directed away from the exhaust port whereby substantially no air can flow directly from the inlet ports into the exhaust port(s). It is further preferred that the seat of each inlet valve is situated closer to the piston than the seat of the or each exhaust valve and this will inherently result in there being a projection or barrier between the inlet ports and the exhaust port(s) which acts as a further impediment to the direct flow of air from the inlet ports to the exhaust port(s).

In a particularly preferred embodiment of the invention the engine has two substantially diametrically opposed inlet ports and two substantially diametrically opposed exhaust ports. In this engine the flows of air through the two inlet ports will merge into a single substantially axial column which flows towards the piston and is then deflected by the piston to flow laterally and then back towards the exhaust ports in the manner of an inverted fountain. The flow of air towards the piston effectively divides into two separate portions as it approaches the exhaust ports, which subsequently flow out through respective exhaust ports. Thus the air motion in this embodiment can be thought of as "tumbling" motion but instead of the single loop or tumbling pattern which is induced in the prior specifications and referred to above there are two separate loops or tumbling patterns, each of which flows along the axis of the cylinder and is thus not concentrated at its outer edges and thereby effectively purges the entire volume of the cylinder.

In this embodiment, and also in the previous embodiment, the axes of the inlet ducts may intersect at a point on the cylinder axis. However, if the engine is of diesel type is may be advantageous if the two inlet ports are slightly offset with respect to the associated diameter and more advantageous if the axes of the inlet ducts also extend on opposite sides of the cylinder axis, when viewed in the axial direction, and are spaced from it by a distance which does not exceed 0.15 R, where R is the radius of the cylinder, whereby the air flows through the inlet ports merge to form a single air flow which rotates substantially about the cylinder axis. This will result in the air in the cylinder rotating about an axis parallel to the cylinder axis as well as one or more axes transverse to the cylinder axis whereby the mixing of the air and fuel is enhanced. Regardless of whether the engine is of diesel or spark ignited type it may be advantageous to provide an elongate recess in the piston crown, the length of the recess being substantially aligned with the diameter on which the exhaust ports lie, since it is found that such a recess is effective in promoting the division of the flow of air towards the piston into two separate flows of air away from the piston. The provision of this recess also enables a very high compression ratio to be achieved whereby at TDC the combustion chamber is effectively constituted by the recess in the piston crown.

Further features and details of the invention will be apparent from the following description of certain embodiments of a multi-cylinder two-stroke engine in accordance with the invention which is given by way of example with reference to the accompanying diagrammatic drawings, in which.

Figure 1:
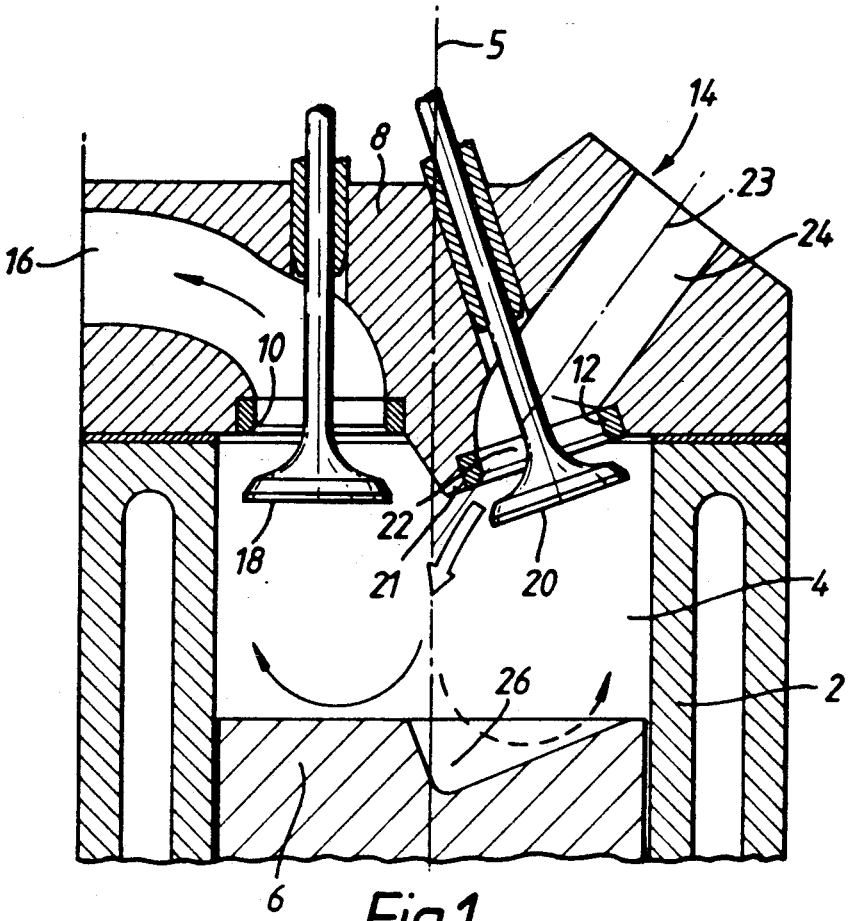
FIG. 1 is a scrap longitudinal section showing the cylinder head and the upper portion of one cylinder of a first embodiment of an engine in accordance with the invention.
Figure 2:
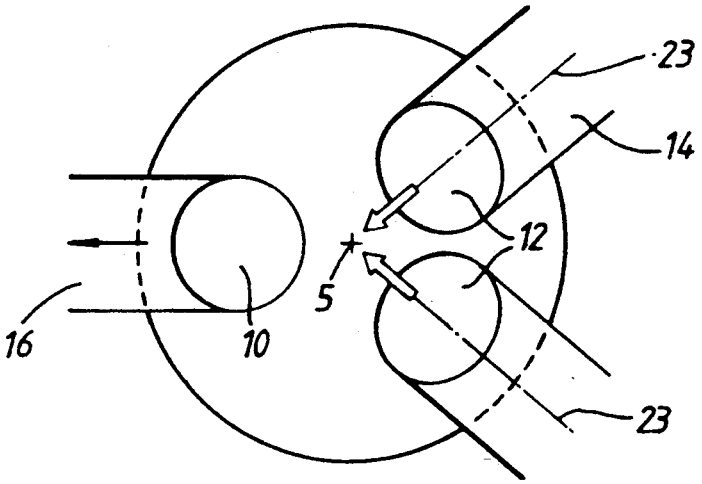
FIG. 2 is a sectional plan view showing the relative disposition of the exhaust and inlet ports of the engine of FIG. 1.

Referring firstly to FIGS. 1 and 2, the engine comprises a cylinder block 2 defining one or more cylinders 4, in this case four cylinders, each of which contains a reciprocable piston 6. The cylinders 4 are closed by a common cylinder head 8 in which a single exhaust port 10, which communicates with an exhaust duct 16, and two adjacent inlet ports 12, which communicate with respective inlet ducts 14, are formed. The exhaust port 10 communicates with one half of the cylinder and the inlet ports 12 with the other half of the cylinder, when viewed in plan, as seen in FIG. 2. The exhaust port 10 is controlled by an exhaust poppet valve 18 whose axis extends parallel to the axis of the cylinder and the inlet ports 12 are controlled by respective inlet poppet valves 20 whose axes are parallel and inclined towards the exhaust valve and subtend an acute angle of 10° to 40° to a line parallel to the cylinder axis.

Extending down from the cylinder head 8 between the inlet and exhaust ports is a projection 21 which carries the spark plug (not shown) and whose purpose will be described below. Each inlet duct comprises an initial short portion 22 immediately adjacent the associated inlet port 12, whose axis is coincident with that of the inlet port and extends, in the direction of flow, away from the cylinder axis, and a longer substantially straight portion 24 whose axis 23 is oppositely inclined to the cylinder axis. The intersection of the short and long portions 22 and 24 is such that the inner edge has a relatively small radius of curvature which does not exceed 0.3 r, where r is the radius of the inlet port, i.e. the radius of the inlet valve seat.

When viewed in plan, the axes 23 of the inlet ducts, i.e. the axes of the major portions 24 of the inlet ducts, are convergent in the direction of flow and define an angle of 20° to 120°, preferably 40° to 90°, and pass through the cylinder axis 5.

Figure 7:
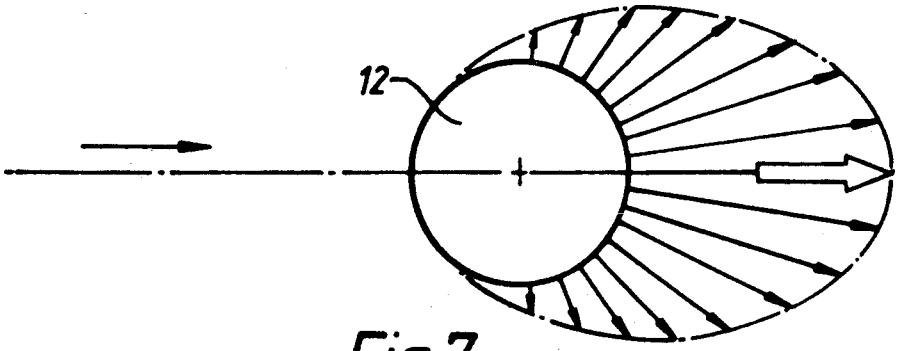
FIG. 7 is a polar diagram showing the velocity and direction of the air flowing through one of the inlet ports.

In use, air flows along the inlet ducts in the direction of the axes of the longer portions 24. Due to the sharpness of the intersection of the long and short portions of the inlet ducts, the air flows into the short portions 22 whilst breaking away from the inner edge of the intersection and essentially "sticking" to the outer edge, when viewed in elevation. The momentum of the air is still principally in the direction of the longer portions 24 of the inlet ducts and it thus flows through the inlet ports essentially only on one side thereof and preferentially or predominantly in a direction parallel to the longer portions 24 of the inlet ducts, as shown by the large arrows in FIG. 2, i.e. the direction towards the axis of the cylinder. This flow pattern is shown more clearly in FIG. 7 in which the horizontal line indicates the axis of an inlet duct and the large arrow indicates the preferential direction relative to the axis of the associated inlet port in which the air flows through the port, i.e. towards the cylinder axis. Thus a certain, but smaller proportion of the air flows in directions transverse to the preferential direction and substantially no air flows out on that side of the inlet port which is remote from the cylinder axis. The air streams through the two inlet ports flow downwardly in the cylinder towards the cylinder axis and due to the fact that they are convergent, merge to form a single, compact and vigorous air flow on or adjacent the cylinder axis. Due firstly to the fact that the inlet ports are inclined away from the exhaust port and secondly to the presence of the projection 21 substantially no air flows directly from the inlet ports to the exhaust ports. The downwardly flowing air stream is deflected by the piston crown and then flows up the cylinder walls towards the cylinder head and effectively purges all remaining exhaust gases out through the exhaust port. In this case a recess 26 is formed in the piston crown which accommodates the projection 22 when the piston is at top dead centre but it would also be possible to make the entire piston crown concave.

Figure 3:
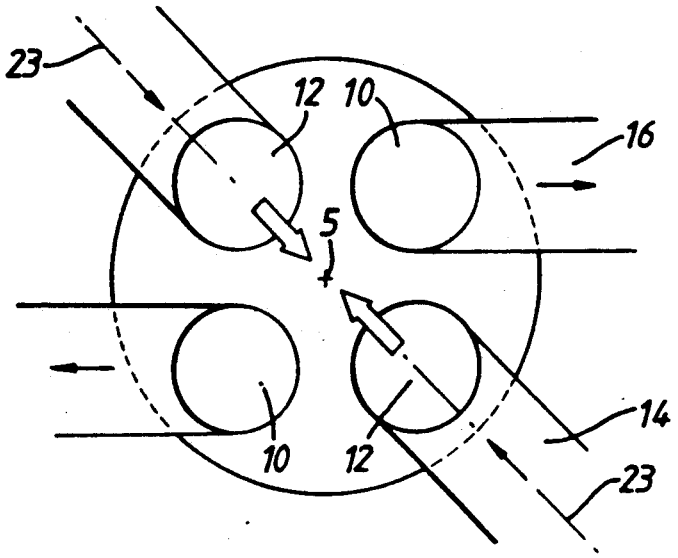
FIGS. 3 and 4 are views corresponding to FIGS. 1 and 2 of a second embodiment of an engine in accordance with the invention.
Figure 4:
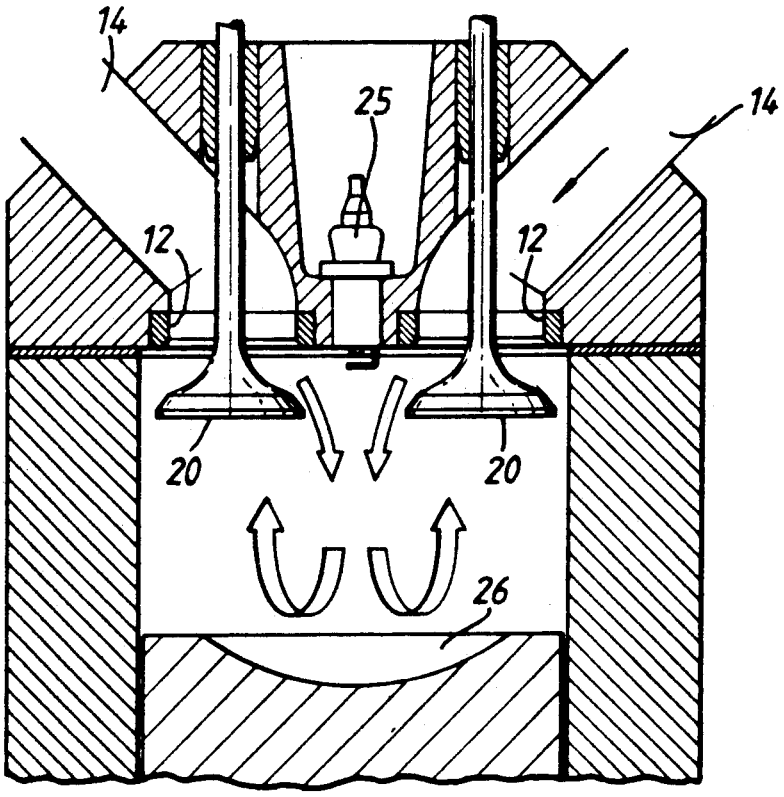
Figure 5:
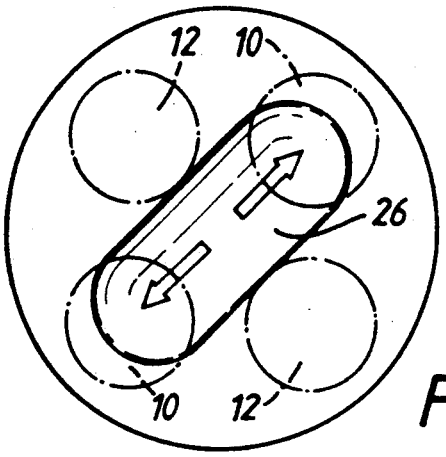
FIG. 5 is a sectional plan view showing the disposition of the recess in the piston crown relative to the inlet and exhaust ports in the engine of FIGS. 3 and 4.

In the embodiment of FIGS. 3 to 5, there are two diametrically opposed inlet ports 12 whose axes extend parallel to the cylinder axis and which are substantially equiangularly spaced, when viewed in plan, from two diametrically opposed exhaust ports 10. The axes of the inlet ducts pass through the cylinder axis 5. In use, the air flows through the two inlet ports converge, when viewed in elevation, and merge to form a strong central stream of downwardly flowing air which purges the central portion of the cylinder and is then deflected by the piston crown and flows up the cylinder walls. However, the downward flow of air tends to divide the upward flow into two equal parts which flow separately into the exhaust ports.

To assist in this dividing process the piston crown is in this case provided with an elongate, arcuate recess or trench 26, whose length is aligned with the diameter on which the exhaust ports lie, as seen in FIG. 5. This trench forms a compact combustion chamber when the piston is at top dead centre and the surrounding areas serve to generate squish, whereby the piston approaches the cylinder head very closely at TDC and forces the gas transversely out of these areas into the trench thereby causing intense and beneficial turbulence in the combustion chamber which promotes rapid and complete combustion.

In this construction the projection 21 is unnecessary and the fact that the axes of the inlet and exhaust ports parallel to the cylinder axis results in the piston being able to approach the cylinder head more closely and thus in a higher compression ratio. The spark plug 25 is again conveniently provided in the central region of the cylinder head between the inlet and exhaust ports.

Figure 6:
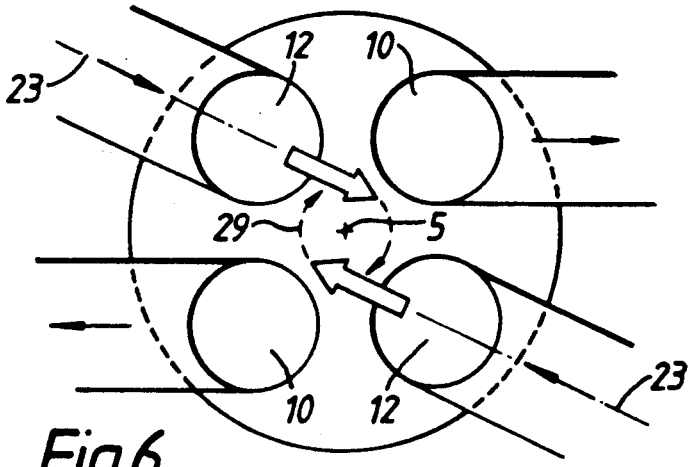
FIG. 6 is a view similar to FIG. 3 of a modified engine which operates on the diesel cycle.

As mentioned above, the invention is applicable to spark ignited or compression ignited engines and in the latter case it is preferable that the air in the combustion chamber rotates about the cylinder axis so as to promote intimate mixing of the fuel and air. Thus when applied to diesel engines the trench or recess in the piston is made more nearly circular. In order to further promote the generation of swirl in diesel embodiments of the invention the axes 23 of the inlet ducts do not pass through the cylinder axis but pass very close to it, within 0.15 R or more preferably 0.1 R from it, where R is the radius of the cylinders, and on opposite sides of it, when viewed in the direction of the cylinder axis. This results in the air flows through the inlets shown by the large arrows in FIG. 6, merging to form a rotating airflow 29, shown by the small arrows in FIG. 6. This airflow continues to rotates when it is deflected by the piston and flows upwardly again. Additionally, the major axis or length of the trench 26 may be offset somewhat with respect to the diameter connecting the axes of the exhaust ports so as to ensure that when the returning air reaches the level of the cylinder head it is substantially aligned with the exhaust ports.

Obviously, numerous modifications and variations of the present invention are possible in the light of the above teachings. It is therefore to be understood that within the scope of the appended claims, the invention may be practiced otherwise than as specifically described herein.

What is claimed as new and desired to be secured by Letters Patent of the United States is:

1. An internal combustion engine including at least one cylinder, said cylinder having an axis, a piston reciprocable within said cylinder and a cylinder head, said cylinder head containing at least one exhaust port, a poppet valve controlling said exhaust port, at least two inlet ports, further poppet valves having respective axes and controlling a respective one of said inlet ports and inlet ducts having respective axes and connected to a respective one of said inlet ports, said inlet ports of directed type whereby, in use, air flowing through them into said cylinder flows preferentially in one radial direction relative to the associated said axis of said further poppet valves generally towards the cylinder axis, said axes of said inlet ducts being convergent and passing substantially through said cylinder axis whereby, in use, the air flows through said inlet ports merged to form a single air flow substantially on said cylinder axis.

2. An engine as claimed in claim 1 wherein said axis of each said inlet duct is inclined to that of said other inlet duct by at least 40°, when viewed transverse to said cylinder axis.

3. An engine as claimed in claim 1 wherein said axis of each said inlet port is inclined away from said axis of said cylinder in the direction in which, in use, air flows through said inlet ports.

4. An engine as claimed in claim 1 wherein each said inlet port and said at least one exhaust port includes a respective seat, said seat of each said inlet port being situated closer to said piston than said seat of said at least one exhaust port.

5. An engine as claimed in claim 1 wherein there are two substantially diametrically opposed inlet ports and two substantially diametrically opposed exhaust ports.

6. An engine as claimed in claim 1 wherein said axes of said inlet ducts intersect on said cylinder axis.

7. An engine as claimed in claim 5 wherein said axis of said inlet ducts intersect on said cylinder axis.

8. An engine as claimed in claim 5 wherein said axes of said inlet ducts extend on opposite sides of said cylinder axis, when viewed along said cylinder axis, and are spaced from it by a distance which does not exceed 0.15 R, where R is the radius of said cylinder, whereby, in use, the air flows through said inlet ports merged to form a single air flow which rotates substantially about said cylinder axis.

9. An engine as claimed in claim 5 wherein said piston has a crown and an elongate recess is formed in said piston crown, the length of said recess being substantially aligned with the diameter on which said exhaust ports lie.

10. An engine as claimed in claim 8 wherein said piston has a crown and an elongate recess is formed in said piston crown, the length of said recess being substantially aligned with the diameter on which said exhaust ports lie.

11. An engine as claimed in claim 5 wherein said at least one exhaust port and said inlet ports have respective axes and said axes extend substantially parallel to said cylinder axis.

* * * * *